US005083959A

United States Patent [19]

Datta et al.

[11] Patent Number: 5,083,959

[45] Date of Patent: Jan. 28, 1992

[54] CRT CHARGING APPARATUS

[75] Inventors: Pabitra Datta, Cranbury; George H. N. Riddle, Princeton; Ronald N. Friel, Hamilton Square; Robert E. Simms, Cream Ridge; Carl C. Steinmetz, Mercerville, all of N.J.

[73] Assignee: RCA Thomson Licensing Corp., Princeton, N.J.

[21] Appl. No.: 565,828

[22] Filed: Aug. 13, 1990

[51] Int. Cl.[5] ..... G03G 15/02

[52] U.S. Cl. ..... 445/52; 250/326; 430/23

[58] Field of Search ..... 445/52, 58; 430/23, 430/24, 25, 26, 28, 29; 354/1; 361/225, 229, 230; 250/326

[56] References Cited

U.S. PATENT DOCUMENTS

| | | | |
|---|---|---|---|
| 3,475,169 | 10/1969 | Lange | 250/326 |
| 3,515,548 | 6/1970 | Lange | 250/326 |
| 3,743,830 | 7/1973 | Takahashi et al. | 361/229 X |
| 4,228,480 | 10/1980 | Benwood | 250/326 X |
| 4,620,133 | 10/1986 | Morrell et al. | 315/15 |
| 4,725,732 | 2/1988 | Lang et al. | 250/326 |
| 4,917,978 | 4/1990 | Ritt et al. | 430/23 |
| 4,921,767 | 5/1990 | Datta et al. | 430/23 |

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

An apparatus for uniformly charging a photoconductive layer disposed on an interior, non-planar surface of a faceplate panel of a CRT during electrophotographic screen processing of the panel includes a corona generator having at least one corona charger and a mechanism for moving the corona charger across the non-planar surface of the faceplate panel. The corona charger substantially conforms to, and is spaced from the photoconductive layer on the non-planar, interior surface of the faceplate panel.

2 Claims, 3 Drawing Sheets

CRT CHARGING APPARATUS

The invention relates to an apparatus for charging a photoconductive layer on an interior, non-planar surface of a faceplate panel of a CRT and, more particularly, to an apparatus for uniformly charging a photoconductive layer disposed on an interior, concave surface of a CRT faceplate panel, during electrophotographic screen processing of the panel.

BACKGROUND OF THE INVENTION

U.S Pat. No. 4,921,767, issued to Datta et al. on May 1, 1990, discloses a method for electrophotographically manufacturing a luminescent screen assembly on an interior surface of a CRT faceplate using dry-powdered, triboelectrically charged, screen structure materials deposited on a suitably prepared, electrostatically-chargeable surface. The chargeable surface comprises a photoconductive layer overlying a conductive layer, both of which are deposited, serially, as solutions, on the interior surface of the CRT panel.

Where the surface of the panel is flat, a conventional linear corona charger, such as those shown and described in U.S. Pat. Nos. 3,475,169 and 3,515,548, issued to Lange on Oct. 28, 1969 and June 2, 1970, respectively, can be used. However, where the interior surface contour of the faceplate panel is non-planar, e.g., spherical or aspherical, a conventional linear charger will not uniformly charge the photoconductive layer and may generate deleterious arcs where the spacing between the charger and the photoconductive layer is reduced below an optimum value.

SUMMARY OF THE INVENTION

In accordance with the present invention, an apparatus for uniformly charging a photoconductive layer disposed on an interior, non-planar surface of a faceplate panel of a CRT, during electrophotographic screen processing of the faceplate panel, is disclosed. The apparatus includes a corona generator having at least one corona charger and means for moving said corona charger across the non-planar surface of the faceplate panel. The corona charger substantially conforms to, and is spaced from the photoconductive layer on the non-planar, interior surface of the faceplate panel.

DETAILED DESCRIPTION OF THE PREFERRED EMBODIMENTS

Figure 1:
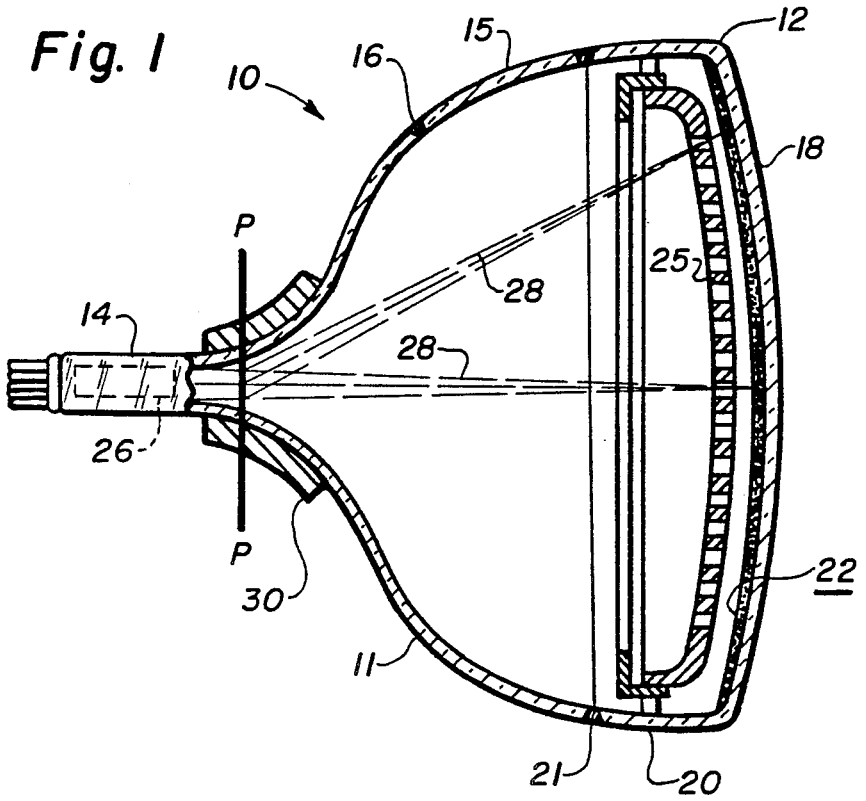
FIG. 1 is a plan view, partially in axial section, of a color cathode-ray tube (CRT) made according to the present invention.
Figure 2:
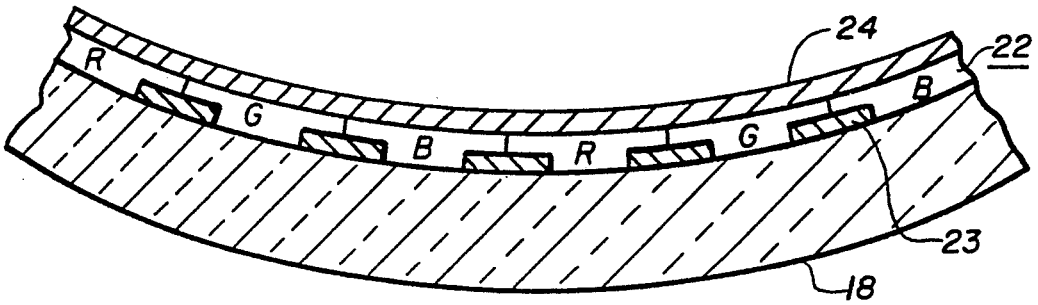
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The inner surface contour of the faceplate is non-planar and may be spherical, for a 48 cm (19 inch) diagonal faceplate, or it may have a complex curvature such as aspheric for larger size faceplates. In the larger size faceplates having an aspheric contour, the radius of curvature along the major axis is greater than along the minor axis. The curvature also may vary along at least the major axis from center to edge. The screen 22, shown in FIG. 2, is a line screen which includes a multiplicity of screen elements comprised of red-emitting, green-emitting and blue-emitting phosphor stripes R, G and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Preferably, at least a portion of the phosphor stripes overlap a relatively thin, light-absorptive matrix 23, as is known in the art. Alternatively, the screen can be a dot screen. A thin conductive layer 24, preferably of aluminum, overlies the screen 22 and provides a means for applying a uniform potential to the screen, as well as for reflecting light, emitted from the phosphor elements, through the faceplate 18. The screen 22 and the overlying aluminum layer 24 comprise a screen assembly.

A multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures in the mask 25, to the screen 22. The gun 26 may be, for example, a bi-potential electron gun of the type described in U.S. Pat. No. 4,620,133, issued to Morrell et al., on Oct. 28, 1986, or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths in the deflection zone are not shown.

Figure 4:
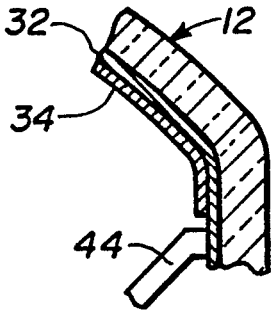
FIG. 4 shows an enlarged portion of the tube faceplate and apparatus within circle 4 of FIG. 3.
Figure 7:
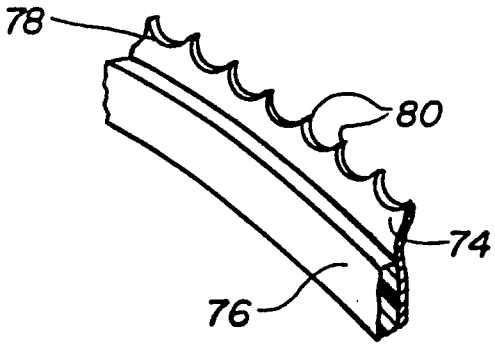
FIG. 7 shows an enlarged portion of a charging electrode within circle 7 of FIG. 6.

The screen 22 is manufactured by an electrophotographic process that is described in the above-mentioned U.S. Pat. No. 4,921,767, which is incorporated by reference herein for the purpose of disclosure. Initially, the panel 12 is washed with a caustic solution; rinsed with water; etched with buffered hydrofluoric acid; and rinsed, once again, with water, as is known in the art. The interior, concave surface of the viewing faceplate 18 is then coated to form a layer 32 of an electrically conductive material which provides an electrode for an overlying photoconductive layer 34. Portions of the layers 32 and 34 are shown in FIG. 4. The composition and method of forming the conductive layer 32 and the photoconductive layer 34 are described in U.S. Pat. No. 4,921,767.

The photoconductive layer 34, overlying the conductive layer 32, is uniformly charged in a dark environment by a novel corona discharge apparatus 36, shown schematically in FIGS. 3, 5, 6 and 7. In the present invention a positive corona discharge is preferred; although, a negative discharge may be used with corresponding, appropriate, changes to the screen structure materials that will provide the proper charge thereon. The apparatus 36 charges the interior surface of the photoconductive layer 34 to within the range of +200 to +800 volts with respect to the underlying conductive layer 32, which is held at ground potential. The shadow mask 25 is inserted into the panel 12, and the positively-charged photoconductor is exposed, through the shadow mask, to the radiation from a xenon flash lamp disposed within a conventional lighthouse (not shown). After each exposure, the lamp is moved to a different position, to duplicate the incident angle of the electron beams from the electron gun. Three exposures are required, from three different lamp positions, to discharge the areas of the photoconductor where the light-emitting phosphors subsequently will be deposited to form the screen. After the exposure step, the shadow mask 25 is removed from the panel 12 and the panel is moved to a first developer (also not shown). The first developer contains suitably prepared, dry-powdered particles of a light-absorptive, black matrix screen structure material, which is negatively charged by the developer. Within the developer, the photoconductive layer 34 is exposed to the negatively-charged, black matrix particles which are attracted to the positively-charged, unexposed area of the photoconductive layer, to directly develop that area. Alternatively, the matrix can be formed by conventional means, known in the art, before the conductive layer 32 is laid down.

The photoconductive layer 34, containing the matrix 23, is uniformly recharged by apparatus 36 to a positive potential, as described above, for the application of the first of three triboelectrically charged, dry-powdered, color-emitting phosphor screen structure materials. The shadow mask 25 is reinserted into the panel 12 and selected areas of the photoconductive layer 34, corresponding to the locations where green-emitting phosphor material will be deposited, are exposed to light from a first location within the lighthouse, to selectively discharge the exposed areas. The first light location approximates the incidence angle of the green phosphor-impinging electron beam. The shadow mask 25 is removed from the panel 12 and the panel is moved to a second developer. The second developer contains e.g., dry-powdered particles of green-emitting phosphor screen structure material. The green-emitting phosphor particles are positively-charged by the developer and presented to the surface of the photoconductive layer 34 where they are repelled by the positively-charged areas of the photoconductive layer 34 and matrix 23, and deposited onto the discharged, light exposed areas of the photoconductive layer, in a process known as reversal developing.

The processes of charging, exposing and developing are repeated for the dry-powdered, blue- and red-emitting phosphor particles of screen structure material. The exposure to light, to selectively discharge the positively-charged areas of the photoconductive layer 34, is made from a second and then from a third position within the lighthouse, to approximate the incidence angles of the blue phosphor- and red phosphor-impinging electron beams, respectively. The triboelectrically positively-charged, dry-powdered phosphor particles from a third and then a fourth developer, are presented to the surface of the photoconductive layer 34, where they are repelled by the positively-charged areas of the photoconductive layer 34 and the previously deposited screen structure materials. The phosphor particles are deposited onto the discharged areas of the photoconductive layer to provide the blue- and red-emitting phosphor elements, respectively.

Figure 3:
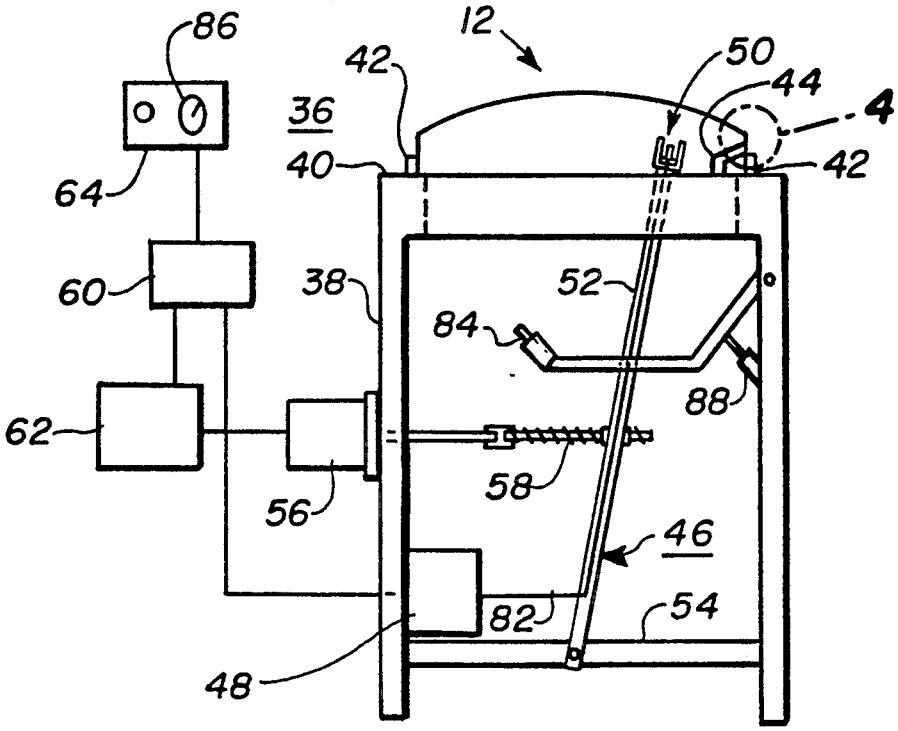
FIG. 3 shows a first embodiment of an apparatus for performing a charging step in the manufacture of the tube shown in FIG. 1.

With reference to FIGS. 3 and 4, the charging apparatus comprises a housing 38 having a faceplate panel support surface 40. A faceplate panel 12, having a conductive layer 32 and a photoconductive layer 34 thereon, is placed upon the support surface 40 and positioned by a plurality of panel alignment members 42, which engage the outer surface of the panel sidewall. An electrical ground contact 44, attached at one end to the housing 38, is spring biased to contact the conductive layer 32. A corona generator 46 is disposed within the housing 38. The generator 46 includes a high voltage power supply 48 which provides a corona voltage to a corona charger 50. The corona charger 50 is pivotably attached, at the center of curvature of the faceplate 12, by means of a support arm 52 to a support bar 54. While only one corona charger 50 is shown, multiple chargers may be used. The support arm 52 is connected to a motor 56 by a reciprocating drive screw 58, which causes the corona charger 50 to make multiple passes across the faceplate panel 12. The ultimate charge on the photoconductive layer 34 is determined by the number of passes across the panel which, in turn, is controlled by a timer 60 which communicates with a motor controller 62 and the high voltage power supply 48. The charging sequence is initiated from a control panel 64.

Figure 6:
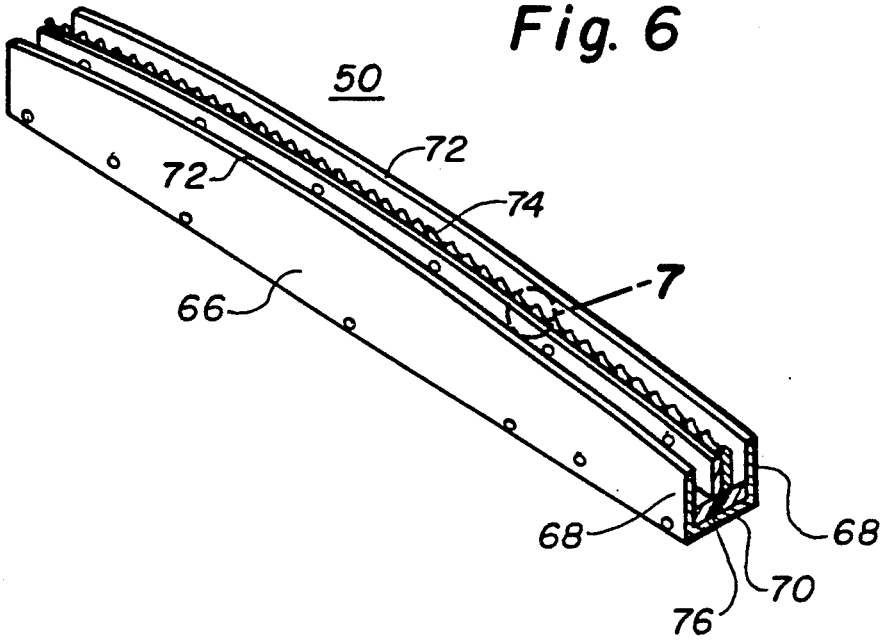
FIG. 6 shows a corona charger used in the present apparatus.

The corona charger 50 is shown in FIG. 6. The corona charger comprises an arcuately-shaped ground electrode 66 having two parallel sides 68 and an interconnecting base 70 which form a U-shaped conductor. The sides 68 terminate in edges 72 which are rounded to suppress arcs during operation. Typically, the ground electrode is made of 3.2 mm (0.125 inch) stock and the edges 72 have a 1.6 mm (0.063 inch) radius of curvature. A foil charging electrode 74 is supported, by means of an insulator 76, between the sides 68 and the base 70 of the ground electrode. The charging electrode 74, shown in FIG. 7, also is arcuately shaped and, preferably, has a substantially arcuately-contoured edge 78 with a plurality of pin-type projections 80 extending therefrom. The arcuately-contoured edge 78 and sides 68 are coincident with the curvature of one axis, for example the minor axis, of the interior surface of the faceplate panel 12. The length of the support arm 52 is adjusted so that the center of curvature of the arc of the charger 50 coincides with the center of curvature of one of the axes of the panel interior surface. For a 48 cm (19 inch) faceplate the center of curvature is about 76.2 cm (30 inch). The charger 50 typically is spaced about 3.2 to 7.6 cm (1.25 to 3.0 inch) from the interior surface of the faceplate panel 12, and the edge 78 of the charging electrode 74 is slightly recessed, e.g., about 0.05 inch, below the edges 72 of the ground electrode 66. A cable 82 (FIG. 3) electrically connects the ground electrode 66 and the charging electrode 74 to the high voltage power supply 48.

In operation, the corona charger 50 is made to pass a multiple number of times across the interior panel surface. The motor 56 is activated to cause the reciprocating drive screw 58 to move the support arm 52, to which the corona charger is attached, through an arc. The high voltage from the power supply 48, typically about 8 to 10 kV above ground potential, is simultaneously applied to the charging electrode 74 in order to generate a corona. The ions formed in the corona drift across the gap between the charger 50 and the panel 12 and settle on the photoconductive layer 34, thereby charging it. Total ion currents of typically about 0.2 mA are sufficient to charge the photoconductive layer 34 on the panel 12 to a potential of about 200 to 800 volts (400 to 800 being preferred) in about 30 to 60 seconds. An electrostatic voltage probe 84, coupled to a voltmeter 86 on the control panel 64, measures the voltage on the layer 34 at the end of the charging cycle. A probe driver 88 moves the probe 84 into proximity with the charged photoconductive layer 34.

Figure 5:
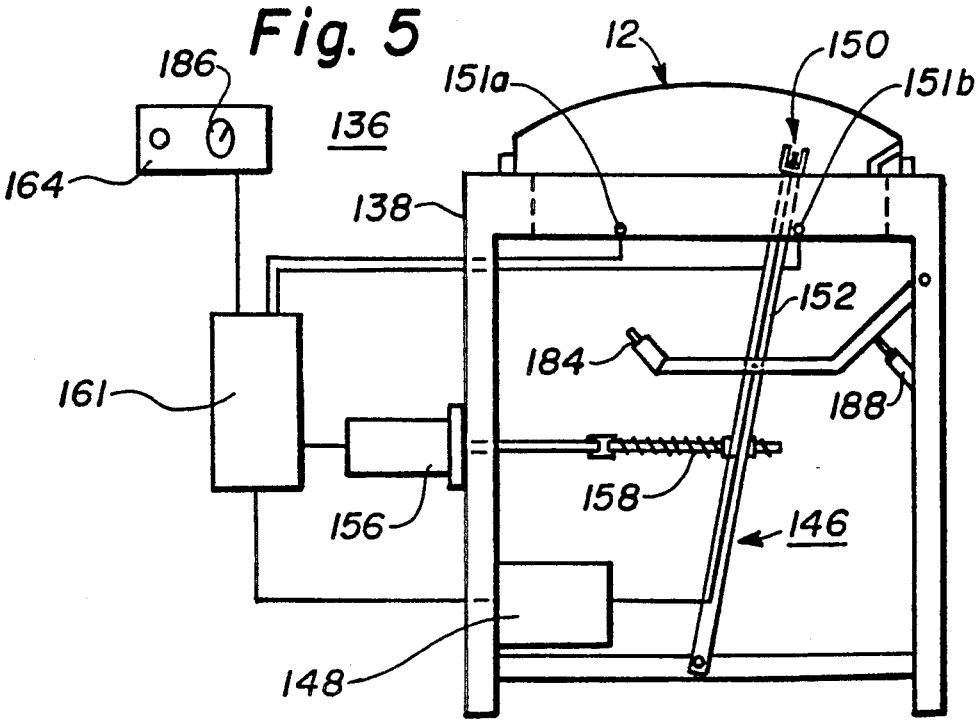
FIG. 5 shows another embodiment of the apparatus for performing the charging step in the manufacture of the tube shown in FIG. 1.

A second embodiment of the present invention is shown in FIG. 5. The charging apparatus 136 is similar to the charging apparatus 36 except that the reciprocating drive screw 58 is replaced with either a single-direction thread-type screw 158, or a belt, and a pair of position sensors 151*a* and 151*b* are located within the housing 138, to sense the arrival of the support arm 152 at the farthermost points of travel. The position sensors 151*a* and 151*b* are connected to a microcomputer controlled indexer 161 which reverses the direction of the corona charger 150 across the interior surface of the faceplate panel 12. The indexer 161 also activates the power supply 148 which provides high voltage to the corona charger 150. A control panel 164, connected to the indexer 161, provides a means to select the number of passes made by the corona charger 150 across the faceplate. As in the previous example, the total ion current is typically about 0.2 mA which is sufficient to charge the photoconductive layer 34 on the panel 12 to a potential of about 200 to 800 volts in about 30 to 60 seconds. At the termination of the charging cycle, a voltage probe 184 is moved into proximity with the photoconductive layer 34 by means of the probe driver 188, and the voltage on the layer 34 is displayed on the voltmeter 186.

What is claimed is:

1. An apparatus for uniformly charging a photoconductive layer disposed on a conductive layer provided on an interior concave surface of a substantially rectangularly-shaped faceplate panel of a CRT during electrophotographic screen processing of said panel, said panel having a major axis with a first center of curvature and a minor axis with a second center of curvature, said second center of curvature being less than said first center of curvature, said apparatus comprising:

a housing having a faceplate panel support surface; means for grounding said conductive layer; a corona generator including means for generating an electrical voltage; at least one corona charger; a support arm attached to said corona charger; and reciprocating means communicating with said support arm, said corona charger having an arcuately-shaped ground electrode with a substantially arcuately-shaped charging electrode disposed therein and electrically insulated therefrom, said arcuately-shaped charging electrode having a substantially arcuately-contoured edge with a plurality of pin-type projections extending therefrom, said corona charger having a center of curvature substantially concentric with one of said first or second centers of curvature, said support arm being pivotably located at the other center of curvature, said reciprocating means being connected to said support arm to swing said corona charger in an arc across said concave surface of said faceplate panel and at a substantially constant distance therefrom, thereby facilitating the charging of said photoconductive layer thereon.

2. The aperture as described in claim 1 wherein said apparatus includes position sensing means to limit the travel of said charger.

* * * * *